US011666800B2

(12) United States Patent
Wilder

(10) Patent No.: US 11,666,800 B2
(45) Date of Patent: Jun. 6, 2023

(54) CHIN-UP/PULL-UP EXERCISE APPARATUS

(71) Applicant: Bryant Wilder, Austin, TX (US)

(72) Inventor: Bryant Wilder, Austin, TX (US)

( * ) Notice: Subject to any disclaimer, the term of this patent is extended or adjusted under 35 U.S.C. 154(b) by 0 days.

(21) Appl. No.: 18/092,334

(22) Filed: Jan. 1, 2023

(65) Prior Publication Data

US 2023/0144431 A1 May 11, 2023

Related U.S. Application Data

(62) Division of application No. 17/316,253, filed on May 10, 2021, now Pat. No. 11,577,124.

(51) Int. Cl.

| | |
|---|---|
| ***A63B 23/12*** | (2006.01) |
| ***A63B 21/00*** | (2006.01) |
| ***A63B 21/068*** | (2006.01) |
| ***A63B 1/00*** | (2006.01) |

(52) U.S. Cl.

CPC ..... *A63B 23/1218* (2013.01); *A63B 1/00* (2013.01); *A63B 21/00181* (2013.01); *A63B 21/068* (2013.01); *A63B 21/4035* (2015.10)

(58) Field of Classification Search

CPC ... A63B 23/1218; A63B 1/00; A63B 21/4035; A63B 21/00181; A63B 21/068

See application file for complete search history.

(56) References Cited

U.S. PATENT DOCUMENTS

| | | | | |
|---|---|---|---|---|
| 3,708,167 | A * | 1/1973 | Potgieter | A63B 21/4047 482/41 |
| 3,752,473 | A * | 8/1973 | LaLanne | A63B 21/4009 482/50 |
| 3,861,675 | A * | 1/1975 | Hopper | A63B 69/12 482/55 |
| 4,111,414 | A * | 9/1978 | Roberts | A63B 1/00 482/102 |
| 5,433,289 | A * | 7/1995 | O'Rourke | A62B 35/0031 182/6 |
| 6,280,361 | B1 * | 8/2001 | Harvey | A63B 24/00 482/4 |
| 7,540,045 | B2 * | 6/2009 | Nativ | A61H 3/04 5/89.1 |
| 7,621,847 | B2 * | 11/2009 | Lamle | A63B 23/12 482/40 |
| 8,147,389 | B1 * | 4/2012 | Hoole | A63B 23/1227 482/37 |
| 10,456,614 | B1 * | 10/2019 | Dube | A63B 24/0062 |
| 11,083,933 | B1 * | 8/2021 | Wilder | A63B 21/4009 |

(Continued)

*Primary Examiner* — Andrew S Lo

(74) *Attorney, Agent, or Firm* — Antony P. Ng; Russell Ng PLLC

(57) ABSTRACT

A chin-up/pull-up exercise apparatus is disclosed. The exercise apparatus includes a frame, an overhead assist module, and a chin bar. The chin bar is connected to the frame. The overhead assist module includes a set of pulleys, a harness, and a cable spool connected to a motor. The set of pulleys, which is connected to the frame, is positioned vertically above the chin bar. A cable, which travels on the set of pulleys, is connected to the harness and the cable spool that can be rotated by the motor. The exercise machine enables real, full arm extension pull ups regardless of one's upper body strength with applications for physical therapy; physical exercise training; muscle, tendon, and joint rehabilitation; and upper and lower body strength building.

12 Claims, 5 Drawing Sheets

(56) References Cited

U.S. PATENT DOCUMENTS

| | | | | |
|---|---|---|---|---|
| 11,478,395 | B2 * | 10/2022 | Thelen | A61B 5/4023 |
| 2008/0011545 | A1 * | 1/2008 | Turner | A62B 35/0037 182/6 |
| 2009/0258761 | A1 * | 10/2009 | Quinn | A63B 21/0626 482/133 |
| 2017/0001055 | A1 * | 1/2017 | Brown | A62B 1/14 |
| 2017/0232289 | A1 * | 8/2017 | Pouchet | A63B 23/03533 482/93 |
| 2018/0214729 | A1 * | 8/2018 | Rubin | A63B 24/0087 |
| 2019/0366141 | A1 * | 12/2019 | Cylvick | A63B 21/4011 |
| 2020/0254309 | A1 * | 8/2020 | Watterson | A63B 21/154 |
| 2020/0384306 | A1 * | 12/2020 | Carter | A63B 23/1227 |

* cited by examiner

CHIN-UP/PULL-UP EXERCISE APPARATUS

RELATED APPLICATION

The present application is a continuation of non-provisional application Ser. No. 17/316,253 filed on May 10, 2021.

TECHNICAL FIELD

The present invention relates to exercise apparatuses in general, and in particular to a chin-up/pull-up exercise apparatus.

BACKGROUND

Chin-ups, pull-ups, dips and deep knee bends are well-known upper body and lower body strength training exercises. During a chin-up exercise, a person grasps an overhead bar with his/her palms facing towards his/her face and raises his/her body up to where the chin is above the overhead bar. A pull-up exercise is similar to a chin-up exercise except the palms are facing away from the face. For a dip exercise, a person supports his/her hanging body on a pair of parallel handles with his/her arms, bends his/her arms at the elbow to lower his/her body, and then pushes his/her body straight up by straightening his/her arms.

Chin-up, pull-up and dip exercises are relatively difficult to do because they require a certain amount of strength. People with weak upper body strength may not be able to do any chin-ups, pull-ups or dips. Even those people that do have sufficient upper body strength may only be able to do a few repetitions.

Various devices have been available for assisting people to do chin-up, pull-up and dip exercises. However, the prior art devices tend to be overly complicated and/or difficult to use, and their design limitations do not provide means to assist pulling the user's chin above the overhead bar.

Consequently, it would be desirable to provide an improved exercise apparatus for assisting people to do chin-ups, pull-ups, and/or dip exercises.

SUMMARY

In accordance with one embodiment of the present invention, an exercise apparatus includes a frame, an overhead assist module, and a chin bar. The chin bar is connected to the frame. The overhead assist module includes a set of pulleys, a harness, and a cable spool connected to a motor. The set of pulleys, which is connected to the frame, is positioned vertically above the chin bar. A cable, which travels along the set of pulleys, is connected to the harness and the cable spool that can be rotated by the motor.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
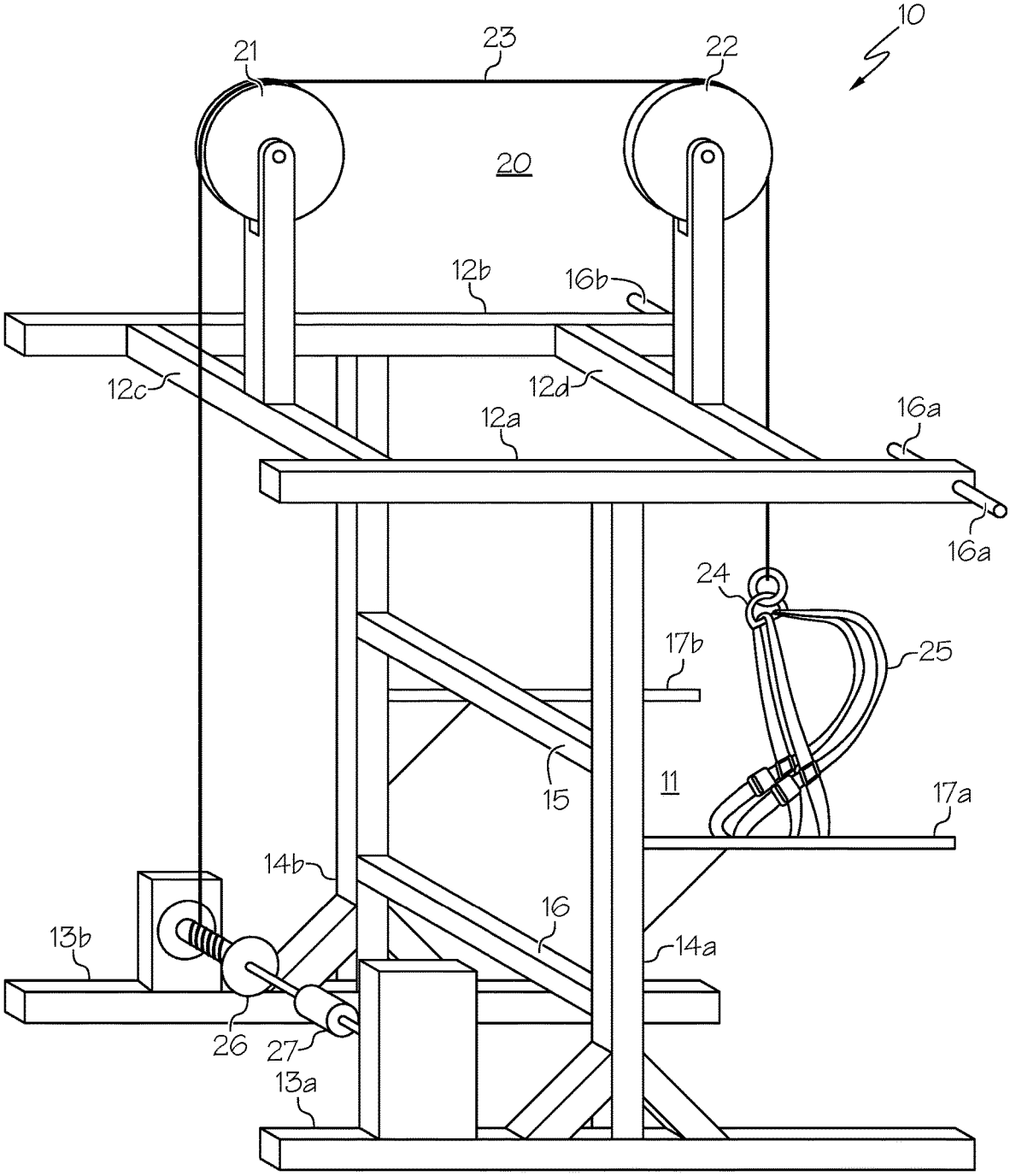
FIG. 1 is an isometric view of an exercise apparatus, according to one embodiment.
Figure 2:
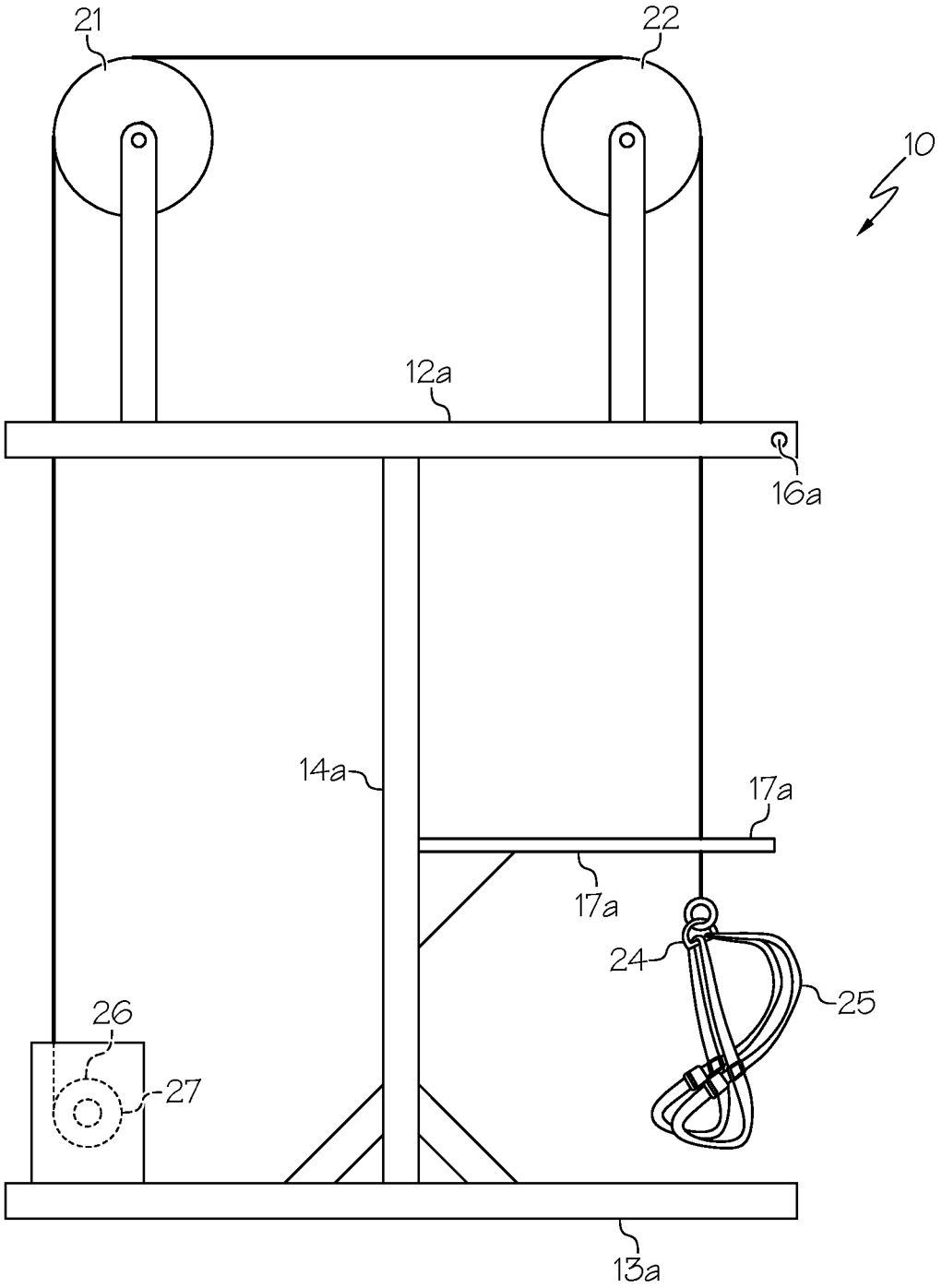
FIG. 2 is a side view of the exercise apparatus from FIG. 1.

Referring now to the drawings and in particular to FIGS. 1-2, there are illustrated an isometric view and a side view of an exercise apparatus, respectively, according to one embodiment. As shown, an exercise apparatus 10 includes a frame 11 and an overhead assist module 20. Frame 11 includes, for example, upper horizontal bars 12*a*, 12*b*, 12*c*, 12*d*, and lower horizontal bars 13*a*, 13*b*. Upper horizontal bars 12*c*, 12*d* are connected to upper horizontal bars 12*a*, 12*b*. Upper horizontal bars 12*a*, 12*b* are connected to lower horizontal bars 13*a*, 13*b* via vertical bars 14*a*, 14*b*, respectively. Frame 11 is preferably constructed from tubular stock.

A chin bar having a pair of handles 16*a*, 16*b* is secured to upper horizontal bars 12*a*, 12*b*, respectively. The chin bar is configured for people to perform chin-up or pull-up exercises. Although the chin bar is shown to be formed by two bars spaced apart on frame 11, it is understood by those skilled in the art that the chin bar can be formed by one single bar.

Similarly, a dip bar having a pair of removable handles 17*a*, 17*b* is secured to vertical bars 14*a*, 14*b*, respectively. The dip bar is configured for people to perform dip exercises.

Overhead assist module 20 allows a person using exercise apparatus 10 to select a suitable positive upward force to assist him/her in doing chin-up, pull-up and/or dip exercises.

In the present embodiment, overhead assist module 20 includes two pulleys 21, 22, a harness 25, and a cable spool 26 connected to a motor 27. Pulleys 21, 22 are secured to upper horizontal bars 12*c*, 12*d*, respectively. Harness 25 is connected to one end of a cable 23 traveling along pulleys 21, 22. Specifically, harness 25 is connected to cable 23 at a ring, such as a D-ring 24. The other end of cable 23 is connected to cable spool 26 that can be rotated by motor 27. Harness 25 is configured to travel along a vertical path as cable spool 26 is being spun by motor 27.

Motor 27 is, for example, a programmable constant-tension motor that can be controlled by a user via a remote control (not shown). By using a remote control, a user can switch motor 27 on and off, change the rotation direction of motor 27 (i.e., clockwise and counter-clockwise), and select a tension (which serves as a weight assistance) between 20 and 100 pounds. A user can also use the remote control to quickly adjust the relative distance between harness 25 and handles 16*a*, 16*b* in order to accommodate the various heights of different users when putting on harness 25.

Figure 3A:
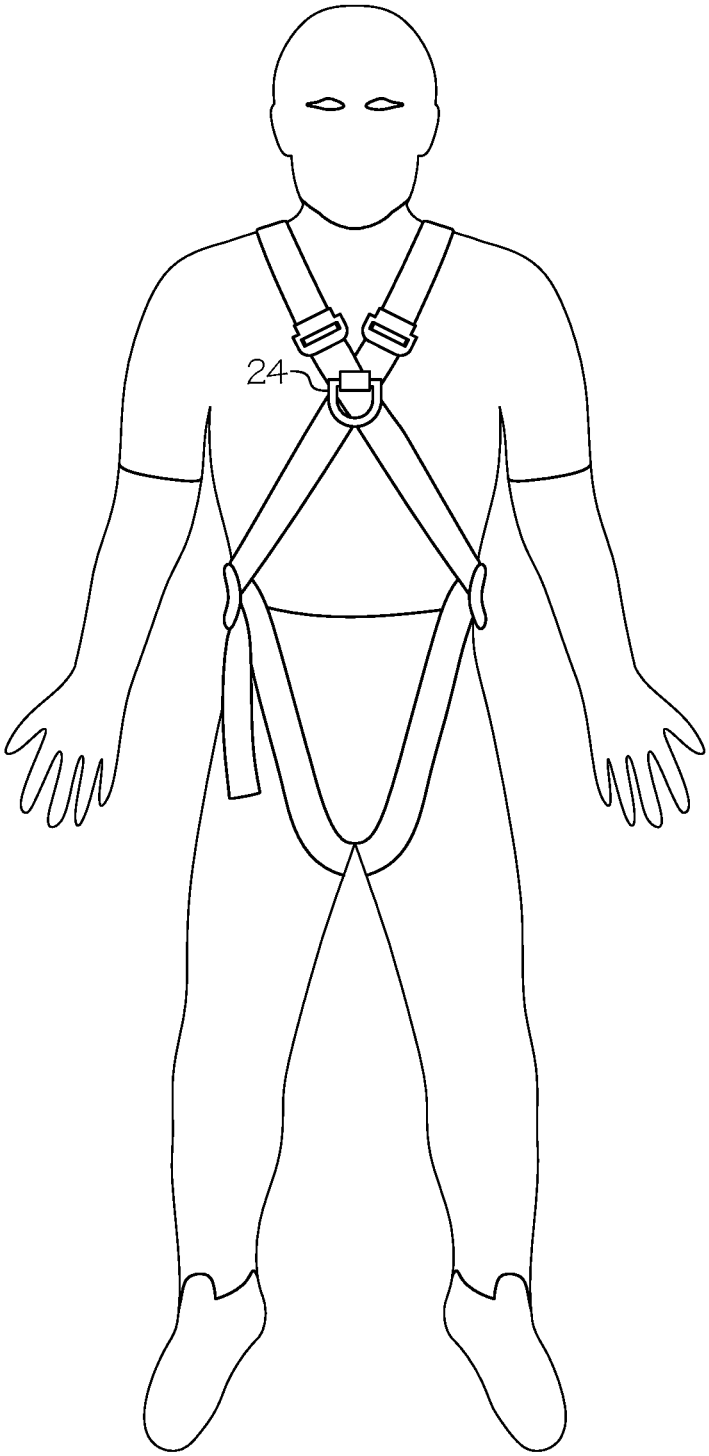
FIGS. 3A-3B are front and back views, respectively, of a user wearing a harness.
Figure 3B:
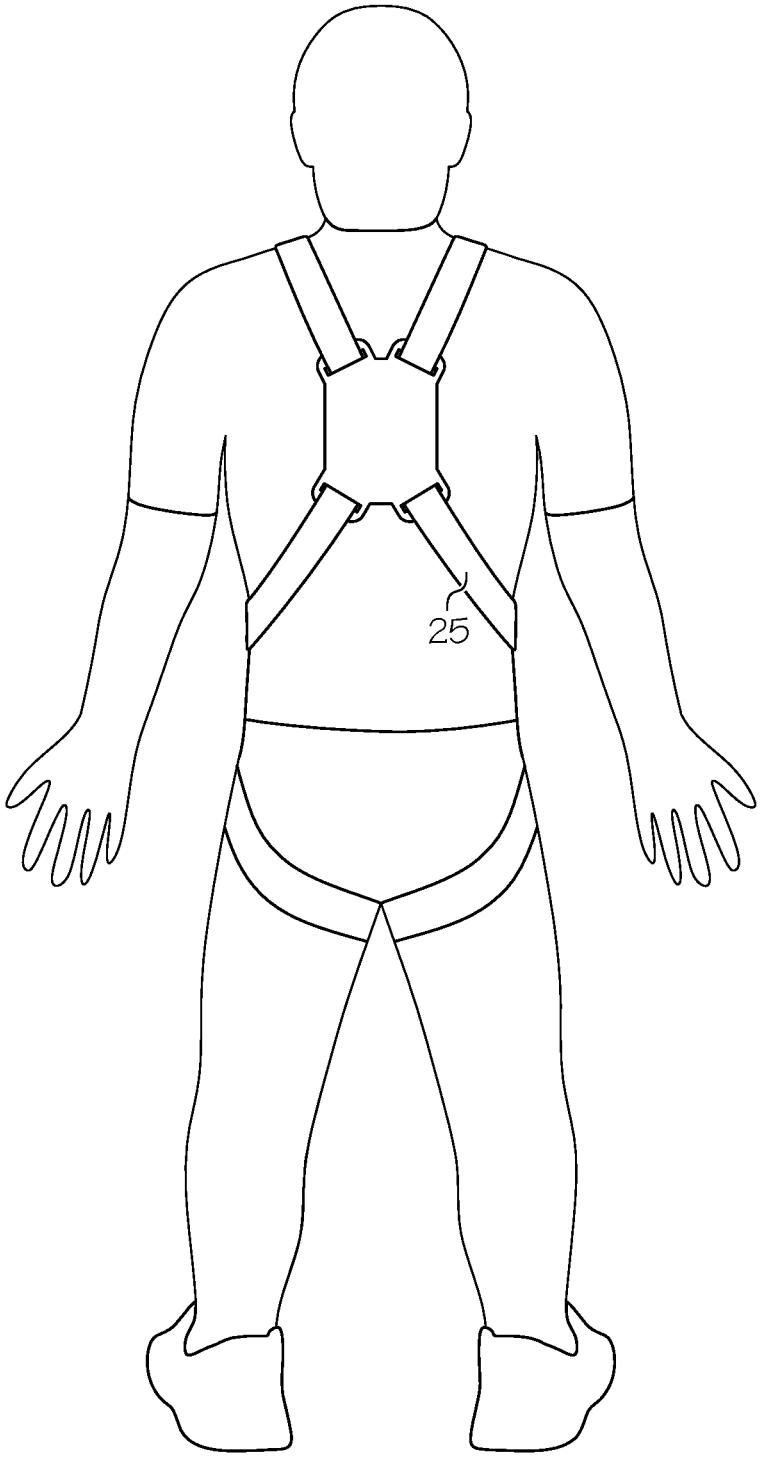

Referring now to FIGS. 3A-3B, there are illustrated isometric views of a user wearing harness 25. As shown, harness 25 is secured to the upper body and the hip area of a user. After harness 25 has been properly worn by a user, ring 24 should be positioned in the front body of the user, and substantially near the sternum of the user. This allows proper hoisting of the user from the tension generated by motor 27 when the user is performing pull-up, chin-up and dips exercises.

Figure 4:
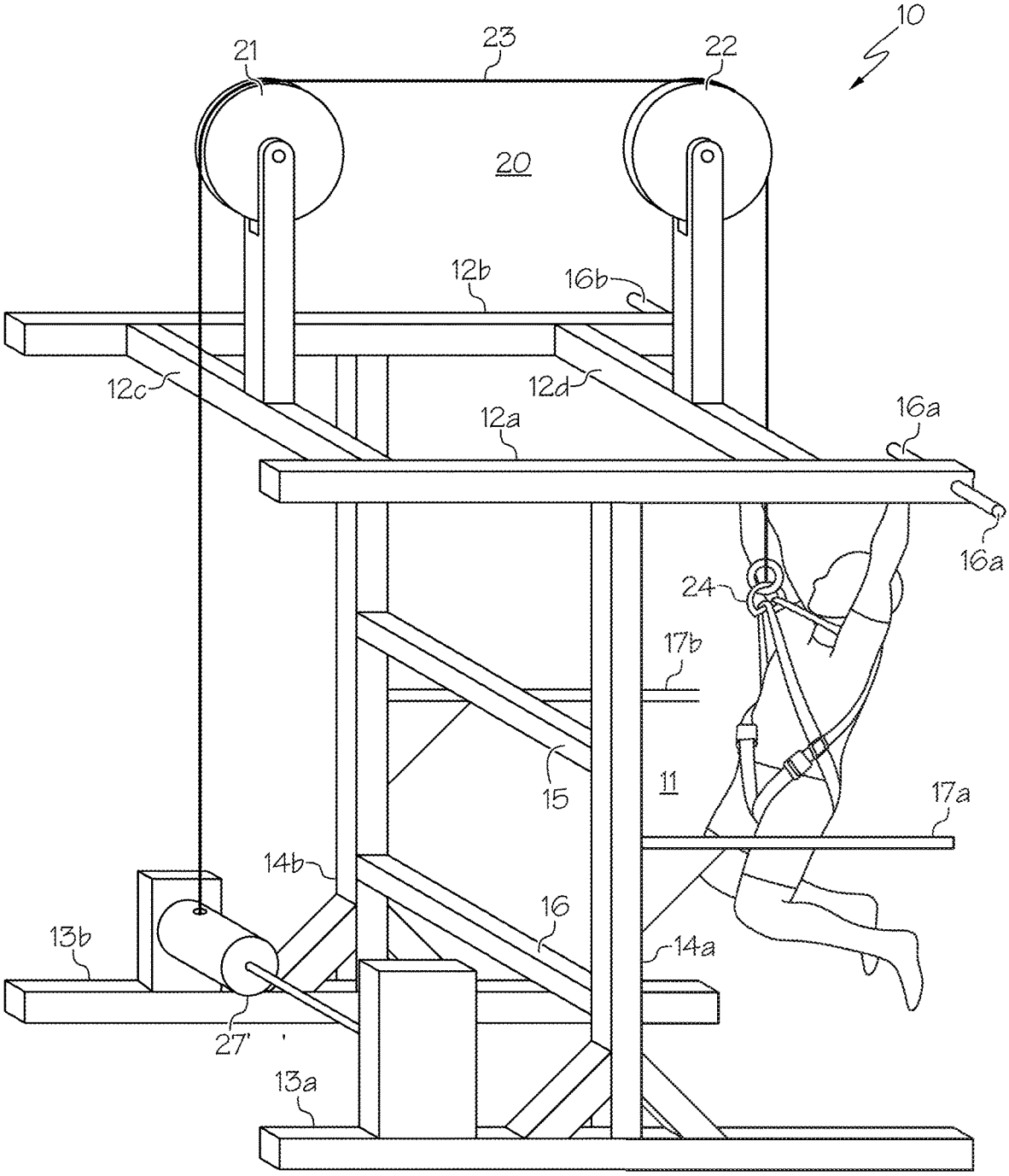
FIG. 4 illustrates a user doing pull-ups on the exercise apparatus from FIG. 1.

With reference now FIG. 4, there is illustrated a user doing pull-ups on exercise apparatus 10. It can be seen with overhead assist module 20 having sufficient tension (or weight assistance) generated by a motor 27', the user can be guaranteed the ability to raise his/her chin above the bar to perform a full extension pull-up/chin-up.

In the embodiment shown in FIG. 1, cable spool 26 is external to motor 27. However, in FIG. 4, an internal cable spool (not shown) is integrated within motor 27', wherein both the internal cable spool and motor 27' share a concentric rotation axis.

As has been described, the present invention provides an improved exercise apparatus for assisting people to do chin-ups, pull-ups, and/or dip exercises.

While the invention has been particularly shown and described with reference to a preferred embodiment, it will be understood by those skilled in the art that various changes in form and detail may be made therein without departing from the spirit and scope of the invention.

What is claimed is:

1. An exercise apparatus, comprising:
a frame;
a chin bar connected to said frame; and
an overhead assist module includes
a plurality of pulleys connected to said frame, wherein said plurality of pulleys is positioned vertically above said chin bar;
a harness;
a cable spool having a cable traveling along said plurality of pulleys, wherein one end of said cable is connected to said harness; and
a motor for rotating said cable spool.

2. The exercise apparatus of claim 1, wherein said plurality of pulleys is two.

3. The exercise apparatus of claim 1, wherein said harness is a body harness having at least two straps configured to meet in front of the sternum of a user.

4. The exercise apparatus of claim 1, wherein said harness is a body harness having a ring connector configured to be positioned in front of the sternum of a user and to be pulled by said cable during exercise.

5. The exercise apparatus of claim 1, wherein said motor is controlled via a remote control.

6. The exercise apparatus of claim 1, further comprising a dipping bar connected to said frame at a location that is vertically below said chin bar.

7. An exercise apparatus, comprising:
a frame;
a chin bar connected to said frame; and
an overhead assist module includes
a plurality of pulleys connected to said frame, wherein said plurality of pulleys is positioned vertically above said chin bar;
a harness;
a motor having an internal cable spool;
a cable traveling along said plurality of pulleys, wherein one end of said cable is connected to said harness and the other end of said cable is connected said internal cable spool.

8. The exercise apparatus of claim 7, wherein said plurality of pulleys is two.

9. The exercise apparatus of claim 7, wherein said harness is a body harness having at least two straps configured to meet in front of the sternum of a user.

10. The exercise apparatus of claim 7, wherein said harness is a body harness having a ring connector configured to be positioned in front of the sternum of a user and to be pulled by said cable during exercise.

11. The exercise apparatus of claim 7, wherein said motor is controlled via a remote control.

12. The exercise apparatus of claim 7, further comprising a dipping bar connected to said frame at a location that is vertically below said chin bar.

* * * * *